United States Patent [19]

Ceravolo et al.

[11] Patent Number: 4,894,867

[45] Date of Patent: Jan. 23, 1990

[54] SPORTS TRUNK

[75] Inventors: Darryl J. Ceravolo, Palm Beach Gardens; Joseph J. Ceravolo, West Palm Beach, both of Fla.

[73] Assignee: Soft Short, Inc., Lake Worth, Fla.

[21] Appl. No.: 299,262

[22] Filed: Jan. 23, 1989

Related U.S. Application Data

[63] Continuation-in-part of Ser. No. 181,498, Apr. 14, 1988.

[51] Int. Cl.[4] ..... A41D 13/00

[52] U.S. Cl. ..... 2/238; 2/227; 2/228; 2/23; 2/DIG. 6

[58] Field of Search ..... 2/238, 227, 228, 79, 2/80, 46, 23, DIG. 6

[56] References Cited

U.S. PATENT DOCUMENTS

| | | | |
|---|---|---|---|
| D. 86,346 | 3/1932 | Baer . | |
| D. 266,540 | 10/1982 | Nachinovich . | |
| 1,308,457 | 7/1919 | Tully . | |
| 1,571,016 | 1/1976 | Lesser . | |
| 1,598,133 | 8/1926 | Hanson . | |
| 1,650,075 | 11/1927 | Karrett | 2/228 |
| 1,698,012 | 1/1929 | Cruden . | |
| 1,711,611 | 5/1929 | Mock | 2/227 |
| 1,863,502 | 6/1932 | Rosenberg . | |
| 1,944,127 | 1/1934 | Jones . | |
| 2,087,045 | 7/1937 | Roberts et al. . | |
| 2,156,206 | 4/1939 | Takahas . | |
| 2,492,444 | 12/1949 | Roessner . | |
| 2,596,112 | 5/1952 | Aines . | |
| 2,637,032 | 5/1953 | Pinsuti | 2/23 |
| 2,779,026 | 1/1987 | Rosecrans, Sr. . | |
| 2,869,138 | 1/1959 | Hankoff . | |
| 2,962,724 | 12/1960 | Wilkens . | |
| 2,962,726 | 12/1960 | Wehrli . | |
| 3,086,529 | 4/1963 | Munz et al. | 2/DIG. 6 |
| 3,200,414 | 7/1965 | Sternberg . | |
| 3,286,375 | 11/1966 | Troy . | |
| 3,312,982 | 4/1967 | Pitman . | |
| 3,328,809 | 7/1967 | Payne et al. . | |
| 3,359,571 | 12/1967 | Burke . | |
| 3,492,675 | 2/1970 | Saltiel . | |
| 3,496,572 | 2/1970 | Herzig . | |
| 3,733,615 | 5/1973 | Jaffee . | |
| 3,766,566 | 10/1977 | Tadokoro . | |
| 3,813,697 | 6/1974 | Beldaume . | |
| 4,017,910 | 4/1977 | Bente . | |
| 4,371,985 | 2/1983 | Pokhis . | |
| 4,372,998 | 3/1983 | Shimada . | |
| 4,479,269 | 10/1984 | Balliet . | |
| 4,498,201 | 2/1985 | Carter . | |
| 4,601,066 | 7/1986 | Campbell . | |
| 4,602,389 | 7/1986 | Brown . | |
| 4,649,574 | 3/1987 | Michels . | |
| 4,677,699 | 7/1987 | Barabe . | |
| 4,692,946 | 9/1987 | Jurga . | |
| 4,700,406 | 6/1987 | Meistrell . | |

FOREIGN PATENT DOCUMENTS

| | | | |
|---|---|---|---|
| 12751 | 6/1902 | United Kingdom | 2/227 |

*Primary Examiner*—H. Hampton Hunter
*Attorney, Agent, or Firm*—Steele, Gould & Fried

[57] ABSTRACT

A bifurcated trunk with thigh length leg portions, each terminating in a lower extremity, has closure structure to tighten the lower extremity. The closure structure can include a slit extending upwardly from the lower extremity and defining first and second sides of the leg portions on respective sides of the slit. Structure is provided for fastening one of the sides of each leg portion to the other. The fastening structure is preferably cooperating hook and pile surfaces, one on each side of the leg portions. The closure structure of the invention is also useful on other types of garments. Padding is provided in the rump area to protect the buttocks against scrapping and bruising. The padding preferably extends a distance into the leg portions where it is influenced by the closure structure so as to retain the flexible padding in a protective position protecting the buttocks and thighs of the wearer even during strenuous sports activity, particularly sliding into bases.

12 Claims, 3 Drawing Sheets

SPORTS TRUNK

CROSS-REFERENCE TO RELATED APPLICATIONS

This is a continuation-in-part application of Applicant's co-pending U.S. patent application Ser. No. 181,498, filed Apr. 14, 1988.

BACKGROUND OF THE INVENTION

1. Field of the Invention

This invention relates generally to garments, and more particularly to shorts for athletic and casual wear. This invention also relates to structures for attaching side edges of a slit in the hems or lower extremities of pants and shorts.

2. Description of the Prior Art

A number of different types of athletic wear have been devised for different athletic settings. Shorts are a popular athletic clothing because of their versatility insofar as they provide maximum flexibility to the wearer. Shorts often are oversized in the leg portions to provide additional flexibility for the wearer.

Slits of one style or another have been provided at the hem or lower extremity of each leg portion to increase the flexibility of garments. Slits have also been provided in clothing to assist the wearer in putting on and taking off these items, and also as artful designs. Closure means for these slits, of varying types and descriptions, have been devised. These closures include buttons and zippers.

Shorts are sometimes constructed to fit the needs of the wearer for a particular activity, which can vary within a single sport. In softball, players must run to retrieve balls and their shorts must have a great deal of flexibility. It is also desirable that the shorts be comfortable, and therefore preferably loose fitting. When players run bases and slide, however, loose fitting shorts tend to travel up the leg and allow the thighs to become scraped and bruised by the sliding contact with the infield dirt. Athletic shorts typically do not offer protection for the wearer against these bruises and bumps, particularly in the area of the buttocks. It would, therefore, be desirable to provide athletic shorts which can be adjusted to be both loose fitting and comfortable, yet also adjustable to be as snug fitting as the wearer desires and to offer protection to the wearer against scrapes and bruises.

Prior art closures for slits in the hems of pants and shorts have not adequately addressed the needs of versatility, strength and adjustability. Wearers with different body types will need different hem sizes to account for a wide variation in thigh sizes for individuals who might otherwise have the same waist size. Also, different individuals have different preferences as to the size of the hem that they are comfortable wearing. It would also be desirable if the hem or lower extremity could be adjusted rapidly so that wearers could change the fit of the garment during play and without having to take the garment off. It would also be desirable for the shorts or trousers to be provided with a structure for tightening the leg portions that would withstand the rigors of athletic competition.

SUMMARY OF THE INVENTION

It is an object of the invention to provide structure for attaching side edges of a slit in the hems or lower extremities of pants and shorts.

It is another object of the invention to provide thigh length shorts for athletic and casual wear which can alternatively be both loose and flexible, and snug and form fitting.

It is still another object of the invention to provide trunks for athletic wear which will help to prevent scrapes and bruises in athletic competition.

These and other objects are accomplished by a thigh length trunk having open-ended leg portions, and structure for tightening the open-ended leg portions. The leg tightening structure preferably comprise cooperating hook and pile surfaces positioned about lower extremities of the leg portions. The hook and pile surfaces permit attachment at any of a plurality of different locations to provide a leg portion the circumference of which is virtually infinitely adjustable within a given range.

The trunks can have at least one slit in each leg portion, which slit has first and second sides. Cooperating hook and pile surfaces are preferably located one on each of the first and second sides. At least one of the pile surfaces is preferably attached to a strap, which in turn is fixed to one of the first or second sides. The strap can be extended across the slit to attach the hook and pile surface on the strap to the hook and pile surface on the other side portion to attach the sides and tighten the hem or lower extremity of the leg portion.

The slit is preferably perpendicular to the hem of the shorts. The slit is located substantially at the lateral outermost portion of each leg in the preferred embodiment. One slit in each leg portion will usually be sufficient, although more can be provided to increase the versatility of the garment.

The leg tightening structure of the invention can also be useful for other types of clothing including trousers and football and baseball uniforms. Slits are provided in the hems or lower extremities of the leg portions. The slits divide the leg portions into first and second sides. A strap having a first hook and pile surface thereon is fixed to a first side. A second cooperating hook and pile surface is fixed to a second side and across the slit. The strap can be used to pull the first side of the leg portion to and over the second side of the leg portion. The first hook and pile surface on the strap can then be fixed to the second hook and pile surface on the second side to secure a snug fit. At least a portion of the strap can be fashioned from an elastic material to increase adjustability of the strap. The wearer can loosen or tighten the fit of the leg portions simply by adjusting the position of the first hook and pile surface on the strap with respect to the second hook and pile surface on the second side of the leg portion.

Padding is positioned at the rump area of the shorts to provide protection against scraping and bruising during athletic competition and play. The padding is preferably dimensioned to substantially cover the buttocks. A single pad can be provided over each buttock area. The padding preferably extends into the leg portion to provide protection for the buttocks and upper thighs, and is influenced by the leg tightening structure so as to retain the flexible padding in a protective position protecting the buttocks and thighs of the wearer even during strenuous sports activity, and particularly when sliding into bases. The padding is thin and flexible, and preferably is no more than one half inch in thickness. The pads can be made to be detachable from the shorts. Detachable fastening means such as cooperating hook and pile surfaces, snaps, buttons or the like can be provided on each of the padding and the shorts.

BRIEF DESCRIPTION OF THE DRAWINGS

There are shown in the drawings embodiments which are presently preferred it being understood, however, that the invention is not limited to the precise arrangements and instrumentalities shown, wherein.

DETAILED DESCRIPTION OF THE PREFERRED EMBODIMENTS

Figure 1:
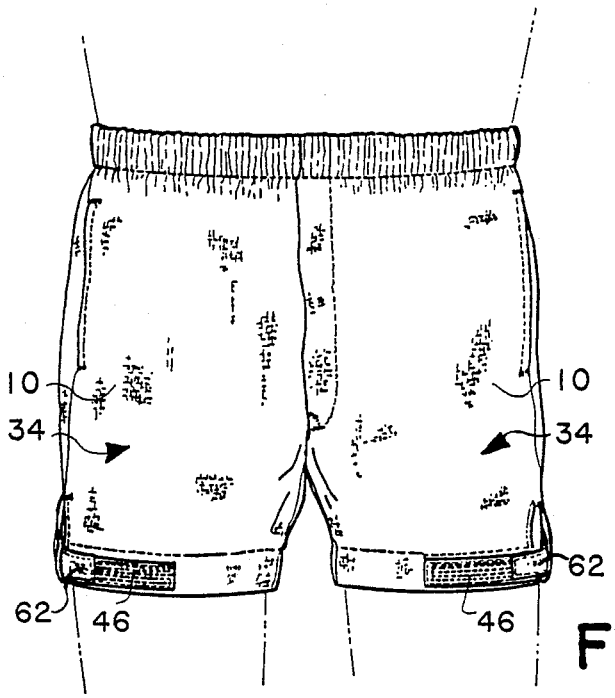
FIG. 1 is a front elevation of shorts according to the invention.
Figure 2:
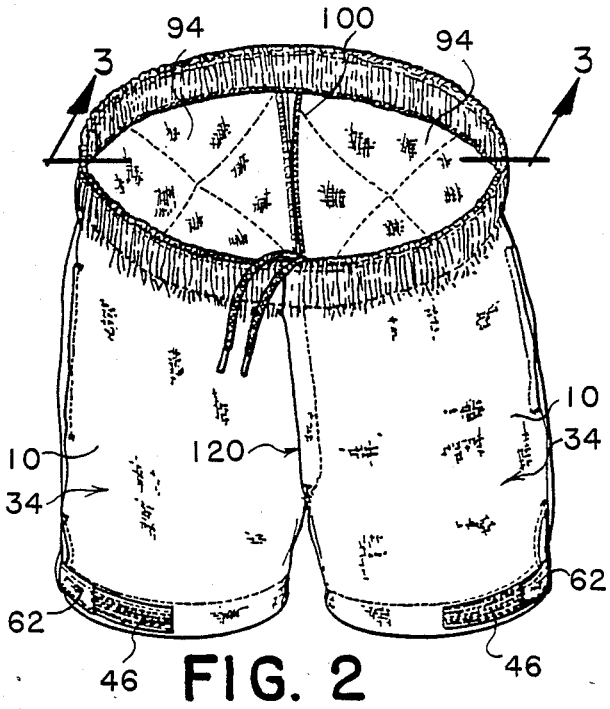
FIG. 2 is a perspective view.
Figure 5:
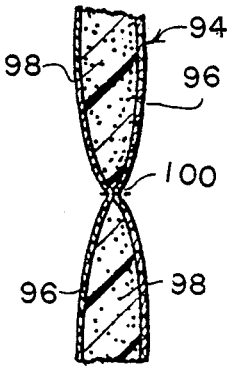
FIG. 5 is a cross-section taken along line 5—5 in FIG. 2.
Figure 3:
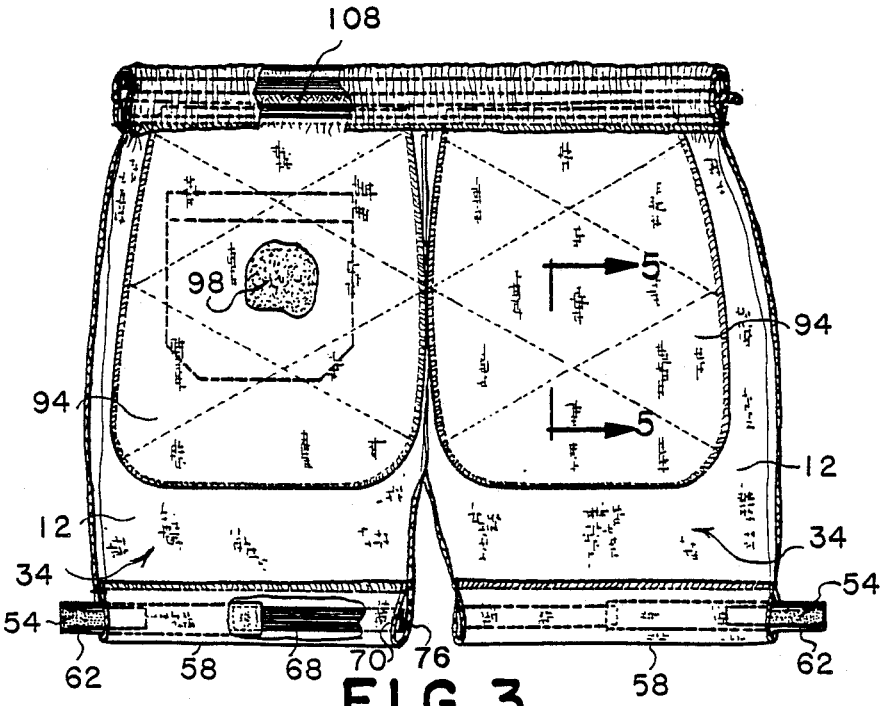
FIG. 3 is a cross-section taken along line 3—3 in FIG. 2, partially broken away.

Shorts according to the invention are shown in FIGS. 1–5. The shorts can be constructed in various styles, and a common design provides a four-panel construction. Each symmetrical half of the shorts comprises a front panel 10, and a rear panel 12. The front panels 10 and the rear panels 12 are joined at each lateral side by a side seam 16. The lateral halves are joined by a front seam 22 and a rear seam 24.

The shorts have leg portions 34 which preferably are substantially thigh length. Each leg portion 34 includes at least one slit 38. The slit 38 extends to the hem or lower extremity of the leg portion. The slit 38 is preferably located on the lateral outermost side of the shorts to provide the greatest flexibility to the wearer. It is within the scope of the invention, however, to position the slit 38 elsewhere on the leg portions 34 or to provide more than one slit in each leg portion 34. Each slit 38 defines a first side 40 and a second side 42.

Structure is provided for tightening the leg portion 34. This structure is adapted to fasten one of the first side 40 and second side 42 to the other. In a preferred embodiment, this structure comprises hook and pile fastening means such as Velcro. A hook and pile strip 46 can be provided substantially adjacent to a lower extremity 50 of the front panel 10 and adjacent to the side 40. A cooperating hook and pile surface 54 is located substantially adjacent the lower extremity 58 of the rear panel 12 and adjacent to the side 42. The cooperating hook and pile surface 54 can be located on a strap 62 which extends from the side 42 of the rear panel 12, and preferably is attached opposite the slit 38.

Figures 4A, 4D, 4E:
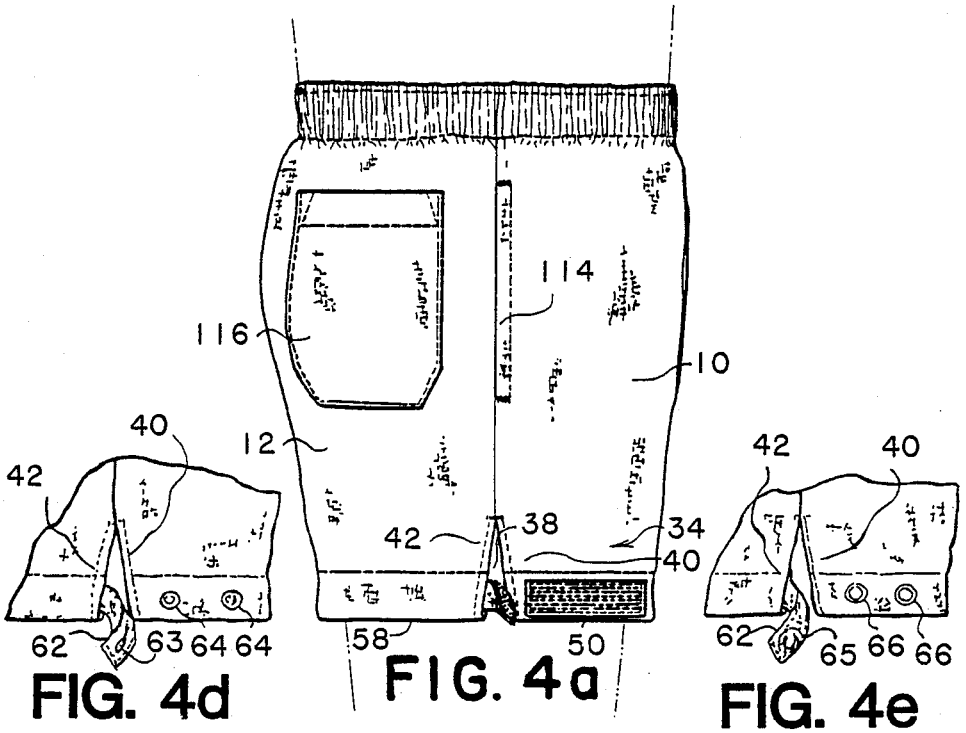
FIG. 4*a* is a side elevation in a first leg portion configuration.
FIG. 4*d* is a partial side elevation showing alternative fastening means.
FIG. 4*e* is a partial side elevation showing still another fastening means.
Figure 4B:
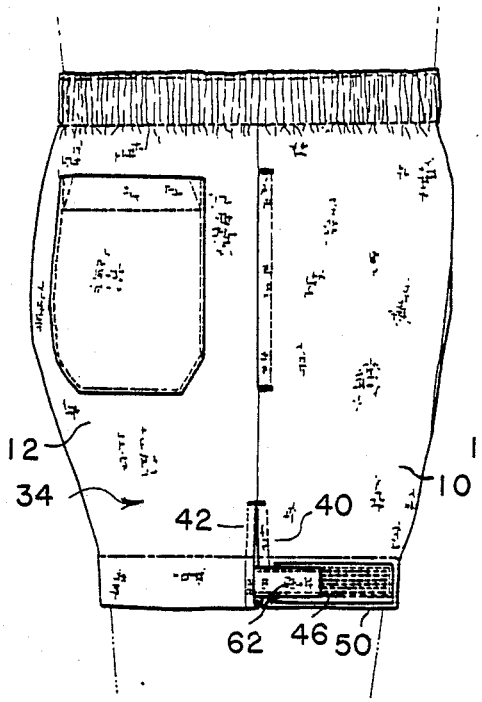
FIG. 4*b* is a side elevation in a second leg portion configuration.
Figure 4C:
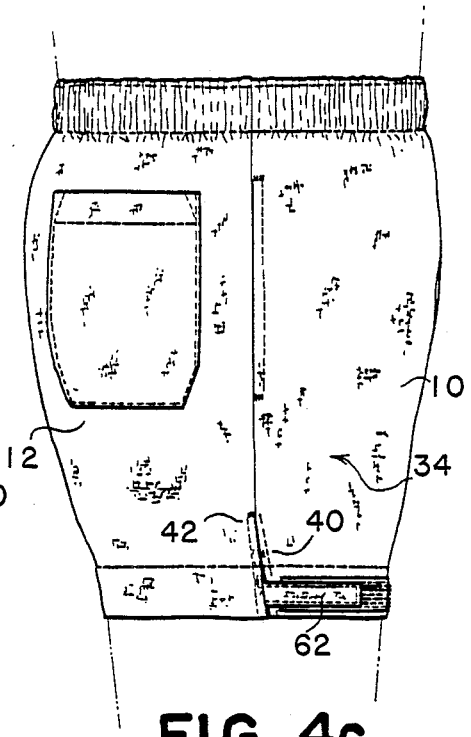
FIG. 4*c* is a side elevation in a third leg portion configuration.

The closure structure of the invention allows the leg portion 34 to be tightened in a variety of different configurations depending on the body size and preferences of the wearer. In FIG. 4*a* there is shown an open configuration wherein the first side 40 and second side 42 are not attached to one another and thereby the front panel 10 and rear panel 12 can flex freely at their respective lower extremities 50 and 58. This provides a loose and comfortable fit, together with maximum flexibility during athletic movement. Should the wearer desire a snug fit, the strap 62 is pressed onto the front panel 10 such that the hook and pile surface 54 contacts the hook and pile strip 46 to firmly engage one side to the other (FIG. 4*b*). The leg portion 34 will thereby be tightened to provide a snug fit. Should the wearer desire or require a still tighter fit, it is a simple matter to adjust the position of the strap 62 on the strip 46 to again change the dimensions of the leg opening of the leg portion 34 (FIG. 4*c*).

Alternative fastening structure can be provided. In FIG. 4*d* there is shown a strap 62 attached to the second side 42 and having a button hole 63. A plurality of buttons 64 are spaced apart on the first side 40 and provide a plurality of points of attachment for the strap 62. The second side 42 can be fastened to the first side 40 by buttoning the strap 62 to any one of the buttons 64, and can be easily repositioned from one of the buttons 64 to another to adjust the size of the leg opening. Snaps can also be used as fastening structure, as shown in FIG. 4*e*. A first snap member 65 can be fixed to the strap 62. A plurality of second snap members 66 can be spaced apart on the first side 40. The first snap member 65 can be fixed to any one of the second snap members 66 to secure the second side 42 to the first side 40. The position of the strap 62 can be quickly adjusted by attaching the first snap member 65 to another second snap member 66.

Figure 6:
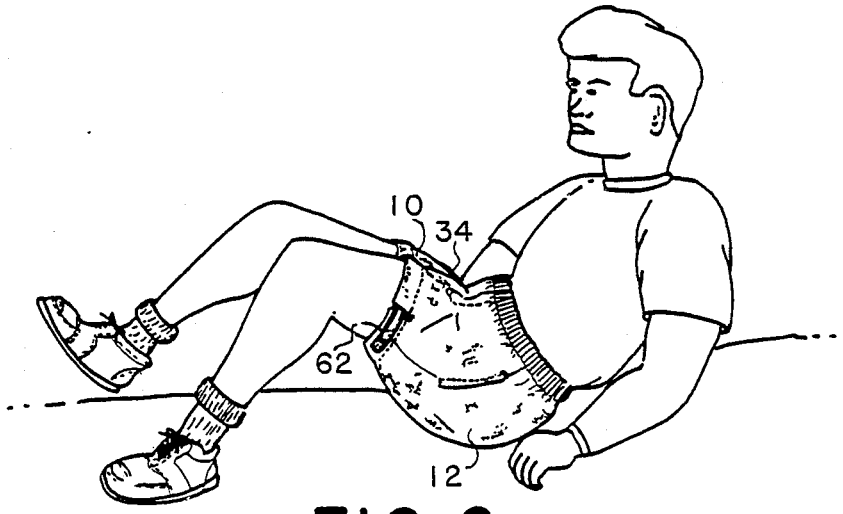
FIG. 6 is a side elevation of an individual sliding in the shorts of the invention.

The leg opening of the shorts of the invention can be tightened or loosened during brief pauses in play to suit the immediate needs of the wearer. The snug fit will prevent the leg portion 34 from riding up on the legs of the wearer to prevent scratching and bruising during activities involving contact of the legs, such as sliding into bases in baseball and softball games (FIG. 6). The leg openings can be quickly loosened by adjusting the position of the strap 62, or by disengaging the strap 62 from the hook and pile surface 46.

The strap 62 can be attached to the leg portion 34 at a point of attachment that is substantially opposite the slit 38, as at the end 76. The strap 62 thereby pulls evenly across the rear panel 12 for a more comfortable and snug fit. The strap 62 preferably comprises an elastic portion 68 which further increases the adjustability of the closure. The strap 62 can be located in a fold of material 70 which serves as a guide to insure the strap 62 does not wobble or hang loosely when not attached. The interior opening of the fold of material 70 preferably substantially matches the cross-section of the strap 62 so that the strap 62 nests snugly within the fold 70. This will help to prevent the strap 62 from retracting into the fold 70 where the strap 62 can be difficult to reach with the fingers. Alternatively, it would be possible to dimension a portion of the strap 62 to be larger than the fold 70 to prevent the strap 62 from retracting into the fold 70.

Pads are preferably provided to prevent scrapes and bruises to the wearer during activities involving contact. Pads 94 can be provided so as to substantially cover the rear panels 12. The pads 94 thereby substantially protect the buttocks of the wearer. The pads 94 preferably extend far enough into the leg portions 34 to be influenced by the leg tightening structure so as to retain the padding in a protective position even during strenuous sports activity, particularly sliding into bases (FIG. 6). The strap 62 secures the leg portions against the thighs of the wearer. The pads 94 can be of any suitable construction, but preferably are flexible and no more than one half inch thick. The pads 94 can be constructed of a wear resistant lining 96 and an interior portion 98 made of an impact-absorbing material such as foam rubber. The pads 94 can be pleated at seams 100 for additional flexibility.

The pads 94 can be sewn directly to the shorts but also can be detachably connected to the shorts by detachable fastening means such as cooperating strips of hook and pile fasteners. Other detachable fastening means are also possible.

The shorts of the invention can be provided with other features which make the shorts more desirable to wear. An elastic waistband 108 helps to insure a snug fit around the shorts. The waistband 108 can be continuous, or discontinuous and secured together by a suitable fastener such as a snap, button or hook. Other snugging devices common to shorts such as drawstrings and belts can also be incorporated into the shorts of the invention. Side pockets 114 and a rear pocket 116 can be provided, as well as a front zipper portion 120.

This invention can be embodied in other specific forms without departing from the spirit or essential attributes thereof, and accordingly, reference should be made to the following claims, rather than to the foregoing specification as indicating the scope of the invention.

We claim:

1. A bifurcated, thigh length trunk, having front and rear, left-hand and right-hand quarter portions, with open-ended leg portions, comprising:

flexible padding substantially covering at least said rear left-hand and rear right-hand quarter portions and extending into said leg portions; and, closure means for adjusting the circumferential fit of the open-ended leg portions, whereby the wearer will be protected against abrasion and bruising by said flexible padding, whereby said closure means can be utilized during strenuous activity to secure said open-ended leg portions against the thighs of a wearer, and whereby said padding extends a sufficient distance into said leg portion to be influenced by said closure means so as to retain said flexible padding in a protective position.

2. The bifurcated trunks of claim 1, wherein the closure means comprises cooperating strips of hook and pile material provided at spaced-apart circumferential positions on said open-ended leg portions, whereby said cooperating strips of hook and pile material can be secured to one another to adjust the circumferential fit of said open-ended leg portions.

3. The bifurcated trunks of claim 2, further comprising a strap fixed to each of said open-ended leg portions at least one of said strips of hook and pile material being provided on said straps.

4. The bifurcated trunks of claim 3, further comprising at least one slit in each open-ended leg portion, the slit extending upwardly from the lower extremity of the open-ended leg portion and defining first and second sides of the leg portion on either side of the slit, said strap being connected to one of said sides of said slit and being adapted for connection across said slit to said cooperating strip of hook and pile material.

5. The bifurcated trunks of claim 1, wherein the closure means comprises at least one slit in each open-ended leg portion, the slits extending upwardly from the lower extremity of the open-ended leg portions and defining first and second sides of the leg portions on either side of the slit, and means for fastening one of the sides of each leg portion to the other side across the slits.

6. The bifurcated trunks of claim 5, wherein the means for fastening one side of the slit to the other comprises cooperating strips of hook and pile material, one of said strips being provided on one side of said slit and the other strip being provided on the other side of said slit, whereby said strips can be joined at a plurality of locations to join the sides of the leg portions and adjust the size of the open ends of the legs.

7. The bifurcated trunks of claim 6, further comprising straps fixed to one of said sides of said slits, one of said cooperating strips of hook and pile material being provided on said strap and adapted to engage said cooperating strip on said other side of said slit.

8. The bifurcated trunks of claim 7, wherein an end of said strap is attached to portion of said open-ended leg portion substantially opposite said slit, whereby said strap will pull substantially across the leg.

9. The bifurcated trunks of claim 7, wherein at least a portion of said strap is elastic.

10. The bifurcated trunks of claim 9, further comprising a channel of material substantially at said open-ended leg portion, said strap extending through said channel.

11. The bifurcated trunks of claim 1, wherein said padding is less than ½ inch in thickness.

12. The bifurcated trunks of claim 1, wherein said closure means comprises at least one strap fixed to said open-ended leg portions, said strap having first fastening means, and further comprising second fastening means fixed to said open-ended leg portions, said first fastening means on said strap being adapted to engage said second fastening means on said open-ended leg portions to adjust the circumferential fit of said open-ended leg portions.

* * * * *